United States Patent [19]

Rotondo et al.

[11] Patent Number: 4,583,379

[45] Date of Patent: Apr. 22, 1986

[54] COLLAR TIP CONSTRUCTION

[75] Inventors: Italo Rotondo, 59 Smart St., Providence, R.I. 02904; Warren Dontigney, North Scituate, R.I.

[73] Assignee: Italo Rotondo

[21] Appl. No.: 661,241

[22] Filed: Oct. 15, 1984

[51] Int. Cl.[4] ..... A44C 25/00

[52] U.S. Cl. ..... 63/2; 24/498

[58] Field of Search ..... 63/2, 14 C, 14 D; 24/498, 102 FC, 67 CF

[56] References Cited

U.S. PATENT DOCUMENTS

| | | | |
|---|---|---|---|
| 322,789 | 7/1885 | Chapman | 24/498 X |
| 534,044 | 2/1895 | Harding | 24/498 X |
| 733,266 | 7/1903 | Phillips | 63/2 |
| 2,773,293 | 11/1956 | Watson | 24/498 X |

FOREIGN PATENT DOCUMENTS

| | | | |
|---|---|---|---|
| 424368 | 5/1911 | France | 24/498 |
| 19537 | 9/1911 | United Kingdom | 63/2 |

*Primary Examiner*—F. Barry Shay

*Attorney, Agent, or Firm*—Salter & Michaelson

[57] ABSTRACT

A collar tip construction of the type adapted to be worn on the substantially triangular terminal portion of a shirt collar lapel comprises a substantially hollow triangular tip element which is receivable on a lapel and a clamping element which is pivotally mounted on the tip element for securing it on the lapel. The clamping element includes an arcuate clamping portion and it is mounted so that the clamping portion is eccentrically pivotable toward the rear side of the tip element to provide a clamping effect for securing the tip element.

1 Claim, 7 Drawing Figures

COLLAR TIP CONSTRUCTION

BACKGROUND AND SUMMARY OF THE INVENTION

The instant invention relates to ornamental jewelry and, more particularly, to a collar tip construction of the type adapted to be worn on the substantially triangular tip portion of a shirt collar lapel.

The wearing of collar tips, particularly by men, on the lapels of shirt collars has become relatively popular, especially in some geographical areas, such as the western and midwestern portions of the United States. Most of the heretofore known collar tip constructions generally comprise a tip element of substantially triangular configuration which is dimensioned and configured to be received on the substantially triangular terminal or tip portion of a shirt collar lapel, and means for securing the tip element on the lapel. The tip element of a collar tip of this type generally comprises a front wall of substantially triangular configuration, a pair of side walls which extend rearwardly from the front wall, and, in some cases, a rear wall which extends between the side walls in rearwardly spaced relation to the front wall. One of the most common securing means utilized in collar tip constructions of the above type comprises a screw element which is threadedly received in the rear wall of the tip element and is engageable with the underside of a lapel to retain the collar tip thereon. Alternatively, other types of collar tip constructions have been embodied with post and clutch elements, for securing them on lapels. However, securing means of these types have numerous disadvantages. First of all, they require substantial manipulation to effect the mounting and removal of the tip element. Secondly, they comprise separate parts which can become lost or misplaced. And lastly, in the case of the pin and clutch types of mounting, the collar lapel is necessarily pierced.

The instant invention provides a novel collar tip construction which when assembled embodies no removable parts, which is easily securable on the tip of a collar lapel without substantial manipulation, and which is attachable to a lapel in a highly reliable manner so that the risks of losing the collar tip are substantially reduced. Specifically, the instant invention provides a collar tip construction comprising a conventional collar tip element and a clamping means which is attached to the collar tip element, and which is moveable to a position of clamping engagement with the undersurface of a shirt collar lapel when the collar tip is received thereon. The clamping means preferably comprises an arcuate clamping portion and a handle portion which is integrally connected to the clamping portion, the handle and clamping portions being pivotally attached to the tip element on the rear side thereof. The clamping means is operable between a first position wherein the handle portion extends generally rearwardly from the tip element and the clamping portion is spaced from the front wall of the tip element by an amount sufficient to slidably receive the triangular terminal portion of a collar lapel therebetween, and a second position wherein the clamping portion clampingly engages the rear side of the terminal portion of a collar lapel received in the tip element and wherein the handle portion is positioned adjacent the underside of the lapel. Further, the clamping portion of the clamping means is preferably of arcuate configuration and it is pivotally mounted in an eccentric disposition so that it is pivotable between the first and second positions above described. In other words, the clamping element is mounted on the tip element so that the clamping portion is pivotable about an axis which is eccentrically disposed with respect thereto, and hence when the clamping element is pivoted to the second position thereof from the first position thereof, a portion of the clamping portion is moved into closer proximity with the rear side of the front wall of the tip element to clampingly engage a lapel received in the tip element. Also, in the preferred embodiment of the collar tip construction, gripping means are integrally formed on the rear side of the front wall of the tip element and the gripping means cooperates with the clamping means to further retain the collar tip on a lapel. Accordingly, the collar tip construction of the instant invention is securable on the tip portion of a collar lapel so that it is reliably retained thereon and the simple operation of the clamping means of the collar tip construction makes it operable with a minimal amount of manipulation. Hence, for these reasons, it is seen that the collar tip construction of the instant invention has substantial advantages over the heretofore known collar tip constructions.

Accordingly, it is a primary object of the instant invention to provide an effective collar tip construction which is simple and easy to operate.

Another object of the instant invention is to provide an effective collar tip construction which can be reliably secured to a collar lapel without any piercing of the collar lapel.

An even further object of the instant invention is to provide an effective collar tip construction having an eccentric clamping portion which is operable for clamping a collar lapel to retain the collar tip thereon.

A further object is the provision of a collar tip construction which has no removable parts in normal use.

Other objects, features and advantages of the invention shall become apparent as the description thereof proceeds when considered in connection with the accompanying illustrative drawings.

DESCRIPTION OF THE DRAWING

In the drawings which illustrate the best mode presently contemplated for carrying out the present invention.

DESCRIPTION OF THE INVENTION

Figure 1:
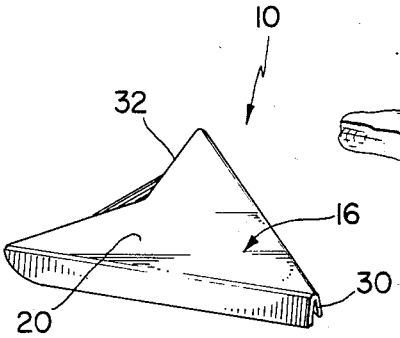
FIG. 1 is a perspective view of the front side of the collar tip construction of the instant invention.

Referring now to the drawing, the collar tip construction of the instant invention is illustrated and generally indicated at 10 in FIGS. 1 through 3, 5, and 6. As illustrated in FIG. 1A, a pair of the collar tips 10 are receivable on the substantially triangular terminal portions of a pair of lapels 12 of a shirt collar 14 to provide decorative ornamentations on the lapels 12. The collar tip construction 10 generally comprises a tip element generally indicated at 16 and a clamping element generally indicated at 18 which is pivotally mounted on the tip element 16, and is operable for clamping the substantially triangular terminal portion of a collar lapel to secure the tip element 16 thereon.

Figure 2:
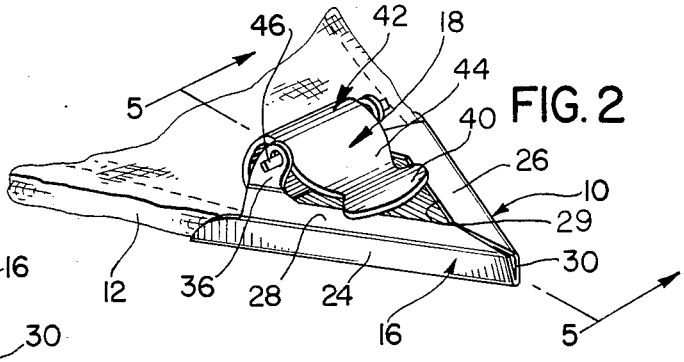
FIG. 2 is a rear perspective view of the collar tip construction in the closed position thereof.
Figure 3:
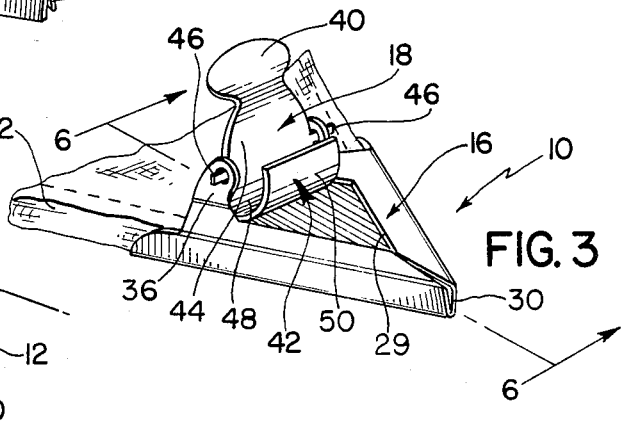
FIG. 3 is a similar view of the collar tip construction in the open position thereof.
Figure 1A:
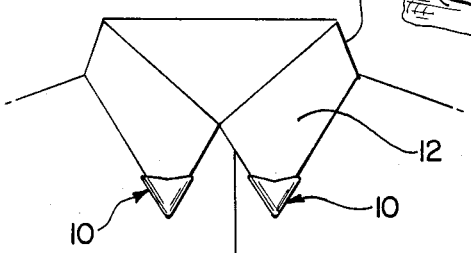
FIG. 1A is a front elevational view of a pair of the collar tips of the instant invention mounted on the lapels of a shirt collar.
Figure 4:
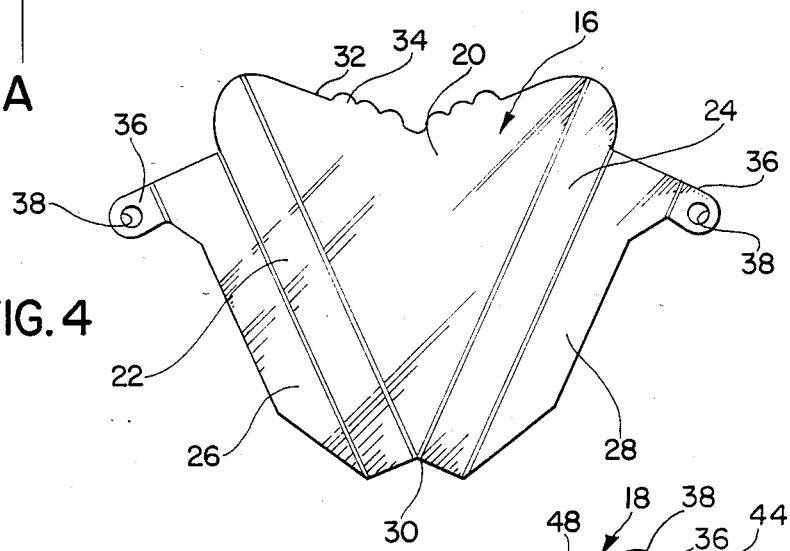
FIG. 4 is a plan view of a metal stamping prior to the formation thereof into a collar tip element.

The tip element 16 is preferably initially formed in a sheet metal stamping operation to assume the configuration illustrated in FIG. 4, and thereafter it is formed in a bending operation in the finished configuration illustrated in FIGS. 1, 2 and 3. The tip element 16 comprises a front wall 20 which is preferably of generally triangular configuration, a pair of side walls 22 and 24 which extend rearwardly from the side edges of the front wall 20 and a pair of rear wall portions 26 and 28 of reduced extents. The rear wall portions 26 and 28 extend inwardly from the side walls 22 and 24, respectively, in rearwardly spaced relation to the front wall 20, and they cooperate to define a substantially triangular opening 29 in the rear side of the tip element 16. The side walls 22 and 24 converge to define an apex 30 at one end of the tip element 16 and the opposite end of the tip element 16 is defined by an upper edge 32 which may be of any suitable decorative configuration. The tip element 16 is dimensioned and configured so that the substantially triangular terminal portion of a collar lapel, such as the lapel 12, is receivable between the front wall 20 and the rear wall portions 26 and 28 and so that the front wall 20 overlies the front surface of the terminal portion of the lapel 12 and the rear wall portions 26 and 28 are disposed adjacent the rear surface of the lapel 12. Integrally formed with the tip element 16 is a pair of gripping elements each having a plurality of blunt gripping teeth 34 which extend rearwardly from the front wall 20 along the edge 32. Also integrally formed with the tip element 16 is a pair of mounting elements 36 which extend rearwardly from the rear wall portions 26 and 28 so that the apertures 38 therein are substantially aligned for pivotally mounting the clamping element 18 in a manner which will hereinafter be more fully described.

Figure 5:
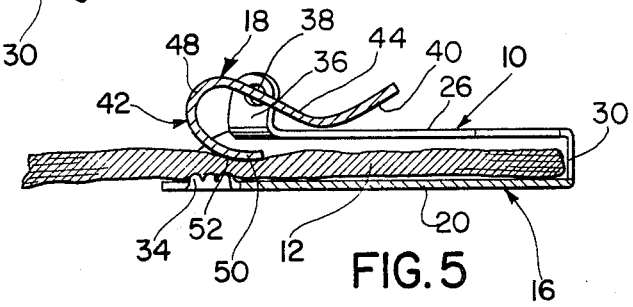
FIG. 5 is a sectional view taken along line 5—5 in FIG. 2.
Figure 6:
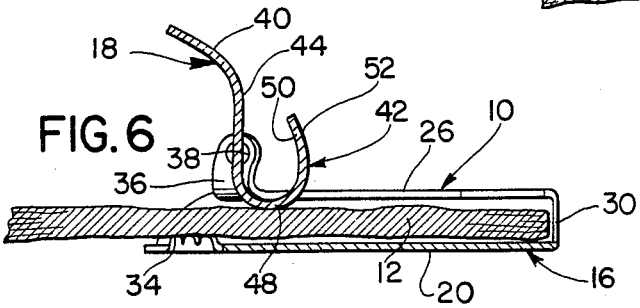
FIG. 6 is a sectional view taken along line 6—6 in FIG. 3.

The clamping element 18 is also preferably integrally formed from a suitable sheet metal and it is preferably formed in a generally J-shaped configuration. The clamping element 18 generally comprises a handle portion 40, an arcuate clamping portion 42, a substantially straight portion 44 which extends between the clamping portion 42 and the handle portion 40, and a pair of integral mounting tabs 46 which extend outwardly from opposite sides of the substantially straight portion 44, adjacent the clamping portion 42. The clamping portion 42 is formed so that it includes a main portion 48 which has a relatively high degree of curvature and a terminal portion 50 which has a reduced degree of curvature and has an outwardly facing clamping surface 52 thereon. The tabs 46 project outwardly from the substantially straight portion 44 of the clamping element 18 adjacent the main portion 48 of the clamping portion 42. The tabs 46 are received in the apertures 38 in the mounting elements 36 for pivotally mounting the clamping element 18 so that it is pivotable in the opening 29 on the rear side of the tip element 16. In this regard, the mounting elements 36 are dimensioned and the tabs 46 are positioned so that the clamping portion 42 is eccentrically pivotable between the clamping position illustrated in FIG. 5 and the open position illustrated in FIG. 6. More specifically, the clamping element 18 is mounted so that when it is pivoted to a position wherein the handle portion 40 extends generally rearwardly from the tip element 16 and the main portion 48 of the clamping portion 42 is adjacent the front wall 20 as illustrated in FIGs. 3 and 6, there is sufficient clearance for a collar lapel to be received between the clamping portion 42 and the wall 20. On the other hand, when the clamping element 18 is pivoted to a position wherein the terminal portion 50 is adjacent the front wall 20 as illustrated in FIGS. 2 and 5, the spacing between the clamping portion 42 and the wall 20 is substantially reduced. As shown in the drawing, terminal part 50 of clamping element 18 moves over lapel 12 along a path about which teeth 34 of the gripping elements are generally symmetrically located. Accordingly, when a collar lapel 12 is received in the tip element 16 and the clamping element 18 is moved to the second or clamping position thereof, the lapel 12 is compressed between the clamping surface 52 of the clamping portion 42 and the rear surface of the front wall 20. In addition, as will be seen most clearly from FIG. 5, when the clamping element 18 is moved to the second or clamping position thereof, the terminal portion 50 is actually pivoted to a point which is slightly beyond its position of closest proximity to the front wall 20 whereby a locking effect is provided which is actually enhanced if one were to try to forceably pull the tip element off the collar lapel. Further, when a collar lapel 12 is received in the tip 10 and the clamping element 18 is moved to the clamping position, the terminal portion 50 actually urges the lapel 12 towards the teeth 34 to provide a gripping effect which further retains the collar lapel 12 in the collar tip 10. Any suitable ornamentation (not shown) may be provided on the outer surface of front wall 20.

It is seen, therefore, that the instant invention provides an effective collar tip construction which includes a clamping element which is easily operable between open and clamping positions, and which is effective for retaining the collar tip 10 on the terminal portion of a collar lapel. A lapel, such as the lapel 12, can easily be inserted into the collar tip 10 when the clamping element 18 is in the open position thereof and, thereafter, the clamping element 18 can easily be moved to the clamping position thereof wherein the handle portion is adjacent the rear surface of the lapel 12 so as to permit the collar lapel to be substantially flat. The clamping element 18 is mounted so that the clamping portion 42 is eccentrically pivotable in the apertures 38 to provide a clamping effect which is operable for positively securing the tip 10 on a collar lapel 12. There is no piercing of the collar lapel, and the collar tip assembly has no removable parts. Accordingly, because of the effectiveness of the collar tip construction of the instant invention and the simple manner in which it can be manipulated, it is seen that the instant invention represents a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A collar tip construction comprising:

a. a tip element comprising a front wall defined by a pair of angularly disposed side edges which meet at an apex and an upper edge which extends between said side edges at the ends thereof opposite said apex, a pair of side walls which extend rearwardly from said side edges, a pair of rear wall portions which extend inwardly from said side walls, a pair of mounting elements which extend from said rear wall portions, and a pair of gripping elements each having a plurality of gripping teeth integrally formed with and extending rearwardly from said upper edge, said teeth terminating in blunt edges; and b. a clamp element pivotally mounted in said mounting elements so that it is pivotable about an exis which extends therebetween, said clamp element comprising an arcuate clamping portion and a handle portion which is disposed on the opposite side of said axis from said clamping portion, said clamp element being constructed and mounted so that it is pivotable along a path about which said gripping elements are located between a position wherein said handle portion extends generally rearwardly from said tip element and said clamping portion is spaced from said front wall by an amount sufficient to slidably receive the terminal portion of a lapel therebetween, and a second position wherein said clamping portion is closely spaced from said front wall adjacent said upper edge so that when a collar lapel is received in said collar tip, said lapel is adapted to be compressed between said clamping portion and said gripping elements.

* * * * *